US009526344B2

(12) United States Patent
Cippe

(10) Patent No.: US 9,526,344 B2
(45) Date of Patent: Dec. 27, 2016

(54) SUPPORT FOR A MUSICAL DRUM

(71) Applicant: Saint-Thierry Saint-Joseph Marie-Reno Cippe, Cayenne (FR)

(72) Inventor: Saint-Thierry Saint-Joseph Marie-Reno Cippe, Cayenne (FR)

( * ) Notice: Subject to any disclaimer, the term of this patent is extended or adjusted under 35 U.S.C. 154(b) by 0 days.

(21) Appl. No.: 14/438,642

(22) PCT Filed: Oct. 18, 2013

(86) PCT No.: PCT/FR2013/052489

§ 371 (c)(1),
(2) Date: Apr. 27, 2015

(87) PCT Pub. No.: WO2014/064372

PCT Pub. Date: May 1, 2014

(65) Prior Publication Data

US 2015/0289661 A1 Oct. 15, 2015

(30) Foreign Application Priority Data

Oct. 26, 2012 (FR) ..... 12 60207

(51) Int. Cl.
*A47C 9/08* (2006.01)
*G10D 13/02* (2006.01)
*G10G 5/00* (2006.01)

(52) U.S. Cl.
CPC ..... *A47C 9/08* (2013.01); *G10D 13/026* (2013.01); *G10G 5/005* (2013.01)

(58) Field of Classification Search
CPC ..... A47C 9/08; G10D 13/026; G10D 13/02; G10G 5/00; G10G 5/005
USPC ..... 297/186, 195.11, 175, 177, 178, 170,297/176, 179; 84/327
See application file for complete search history.

(56) References Cited

U.S. PATENT DOCUMENTS 866,818 A * 9/1907 Schroeder, Jr. ..... A01J 1/00 297/179
2,505,882 A * 5/1950 Cassato ..... G10D 13/00 24/129 R
2,625,985 A * 1/1953 Morgan ..... A47C 9/10 248/121
3,259,428 A * 7/1966 Wenger ..... A47C 9/08 211/85.6
4,112,807 A * 9/1978 Quibell ..... G10D 13/02 84/411 R
5,531,148 A * 7/1996 Wilson ..... G10D 13/024 84/412
5,744,738 A * 4/1998 Gatzen ..... G10D 13/00 248/124.1
6,073,999 A 6/2000 Crane
6,585,315 B1 7/2003 Vail
7,128,368 B2 * 10/2006 Sligh ..... G10D 13/00 297/186
7,858,859 B2 12/2010 Bassam
(Continued)

FOREIGN PATENT DOCUMENTS

DE 4101495 A1 7/1992
FR 000590494 A * 6/1925

*Primary Examiner* — Milton Nelson, Jr.
(74) *Attorney, Agent, or Firm* — Jordan IP Law, LLC; Todd A. Vaughn

(57) ABSTRACT

A support for musical drums, more particularly, for a Guianese, West Indian, African, and any other type of drum played sitting down, and which provides an improvement in the posture of the drum player which can then relieve the pressure on the body.

13 Claims, 4 Drawing Sheets

(56) References Cited

U.S. PATENT DOCUMENTS

Figure 1A:
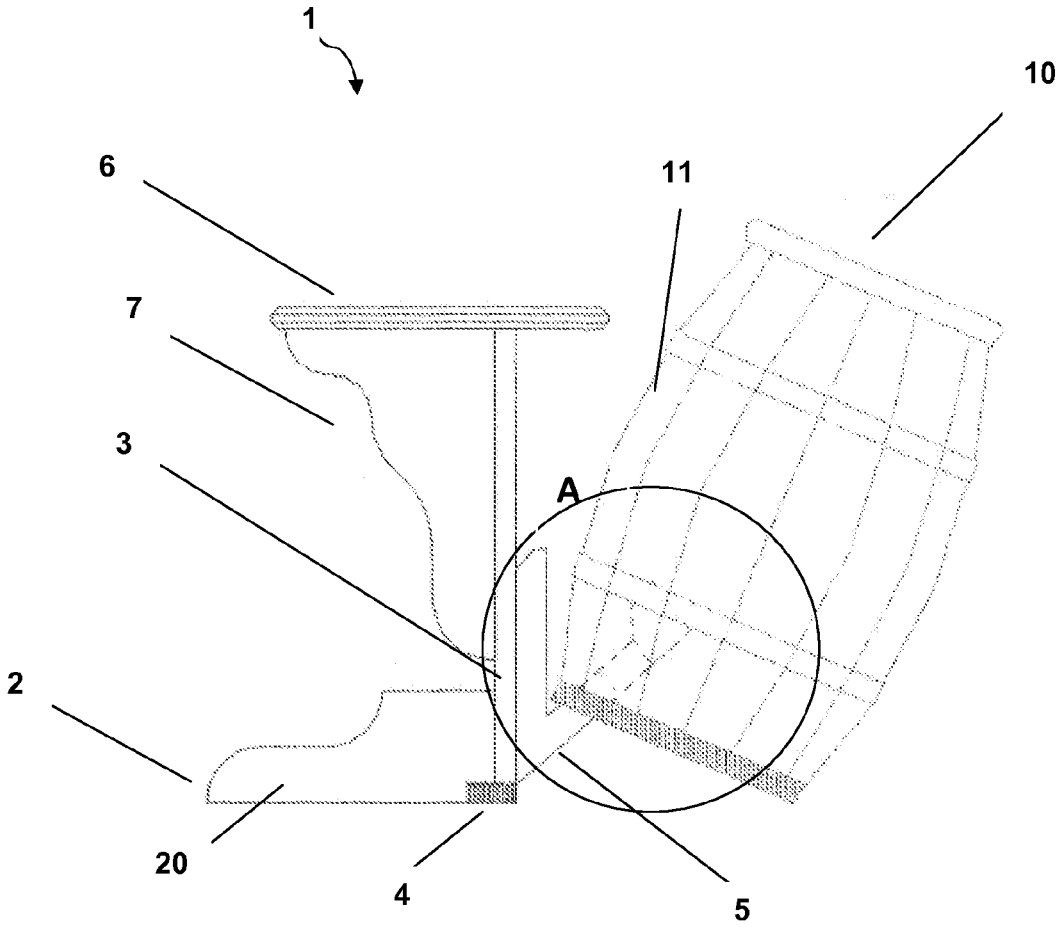

2005/0029841 A1* 2/2005 Larrick ..... A47C 9/08
297/186

* cited by examiner

SUPPORT FOR A MUSICAL DRUM

CROSS-REFERENCE TO RELATED APPLICATIONS

The present application is a National Stage Application of PCT International Application No. PCT/FR2013/052489 (filed on Oct. 18, 2013), under 35 U.S.C. §371, which claims priority to French Patent Application No. A 12 60207 (filed on Oct. 26, 2012), which are each hereby incorporated by reference in their respective entireties.

FIELD OF INVENTION

Embodiments relate to the field of supports for musical instruments, and more particularly, to a support for a musical drum.

BACKGROUND

There are many drums of different sizes and shapes, that can be used either by striking the skin of the drum with the bare hands, or by using various objects, in particular drumsticks. The African drum is part of the most widely known and used drums. But there are other types of drums and in particular the Guianese drum which has for main characteristic a system of fasteners, called "keys" that make it possible to tune the drum to the sound desired. Such drums (African or Guianese) are generally comprised of a main body made of wood and more specifically of a hollow trunk. The body of the drum generally has a substantially circular section and a substantially cylindrical shape, with a diameter that can be constant over the entire height thereof or variable; for example the diameter can be greater in the upper portion thereof. The Guianese or West Indian drum has the shape of a barrel, and can furthermore be manufactured from wooden slats, like a barrel. On the upper portion of the drum is a stretched skin, with said skin being of animal origin or manufactured from synthetic material. The lower portion of the drum is used to evacuate the sound waves resulting from the pressure of the air when the drum player strikes the stretched skin.

There are many supports for drums, such as described for example in documents German Patent Publication DE 4101495 (Speiser), U.S. Pat. No. 7,128,368, and U.S. Pat. No. 7,858,859. They are not entirely suited to the Guianese, West Indian or African drum. Generally, the player of a Guianese, West Indian or African drum must hold said drum between his knees and must tilt the drum slightly when he plays. It is also possible for the player of the African drum only to fasten the drum by means of straps on his shoulders, with the weight of the drum supported by the player. Alternatively, the player can use a stool and hold the drum between his legs.

U.S. Pat. No. 6,073,999 describes an improved support device for a musical drum, preferably for an African drum, with said support being in combination with a seat. The support comprises a rigid frame connected to a seat, said frame comprising at least two branches and an opening able to receive the drum in such a way that the drum rests on said frame, with the drum being suspended and the playing surface being tilted on the side opposite the seat. This device allows the musician to play with greater comfort, as he no longer has to support the weight of the drum or to hold it between his knees or his legs. On the other hand, this device has the major disadvantage of not being able to be adapted to any shape of drum, as the frame of the support device is of fixed dimensions, it is as such not possible to use it with drums of which the diameter of the central body is too large. Inversely, drums of small diameter cannot be held by the frame of the device. In addition, the rigidity of the support imposes upon the player to adopt a seating position according to the size and the shape of the drum, and therefore results in more energy being expended by the player, and more or less over the long term according to the frequency of use, pains and stiffness of the back, of the neck and/or of the arms according to the position adopted.

SUMMARY

A purpose of embodiments is to provide a new support for musical drums, more particularly for the Guianese, West Indian or African drum and any other type of drum played sitting down, that makes it possible to respond to the aforementioned disadvantages. Another purpose of the invention is to propose a support for a drum that provides an improvement in the posture of the drum player which can then relieve the pressure on the legs and more particularly the thighs, the hips, the neck, the back, but also the arms. This support makes it possible to breathe better, there is less blocking of the chest, less shortness of breath. In sum, the invention has for purpose to protect the health of players via a posture and a sitting position that become more flexible and freer, thus making is possible to improve the music. Furthermore, it offers more comfort to children who are learning to play the drum, and who do not always have legs long enough to encompass the drum.

In accordance with embodiments, a support 1 for a drum 10 with a built-in seat 6 having a sitting surface, in particular for Guianese, West Indian or African drum, and any other type of drum played sitting down, and which comprises: substantially flat horizontal support element 4; substantially flat vertical support element 3, arranged on the horizontal support element 4; said vertical support element 3 supporting the sitting surface of the built-in seat 6; a means for holding 5 said drum 10, arranged on at least one of the surfaces of the vertical support element 3, characterized in that said means for holding 5 is in the form of an essentially flat profiled part 5, bent at the two ends 5*a*, 5*b* thereof, of which one of said two ends 5*b* is able to cooperate with the inner surface 11 of the drum 10 in order to hold said drum 10 on the support 1 with a built-in seat 6, and characterized in that the other of said ends 5*a* is attached to said vertical support element 3.

In accordance with embodiments, the bending angle between the end 5*a* and the middle portion 5*c* of the means for holding 5 in the form of a profiled part 5 is between 35° and 45°, preferentially between 37° and 43°, and even more preferentially between 39° and 41°. Advantageously, the means for holding 5 is interchangeable.

In a preferred embodiment, the element for holding 5 and the vertical support element 3 comprise fastening elements intended to cooperate with each other.

Advantageously, the fastening elements are recesses and protuberances or dovetailed elements. More advantageously, the support 1 for a drum further comprises a base 2 and a seat console 7 in order to stabilize and rigidify said support 1. Advantageously, the support 1 comprises a seatback for a seat 12 and a seatback console 13, preferably removable or retractable. In a first alternative embodiment, the seatback console 13 is attached on the one hand to the base 2 and on the other hand to the seat console 6 by fastening elements that cooperate together, such as recesses and protuberances. In a second alternative embodiment, the seatback 12 and the seatback console 13 are arranged in the form of a telescopic system comprising a telescopic rod attached at one end to the base 2 by fastening elements that cooperate with each other, such as recesses or protuberances.

In a particular embodiment, the support 1 comprises suction fastening devices placed on the front surface 40 of the horizontal support element 4 and/or on the lateral surfaces 20 of the base 2 in order to improve the adherence to the floor of said support.

In a further particular embodiment, the means for holding 5 comprises a slot 51 arranged in the middle portion 5*c* of said means for holding 5, said slot 51 able to receive a fastening system, such as a nut and screw system, that makes it possible to fasten the drum 10 onto said means for holding 5, said drum 10 being pierced on its lower portion.

Preferably, the elements that constitute said support are made of wood and/or of metal, in particular of aluminum or of steel, and/or of plastic materials. In a particular embodiment, all of the elements that comprise the support 1, if they are made of metal, are covered with a covering, for example carpeting, in order to prevent the vibration and the resonance of said elements comprising the support which would modify the sound of the drum.

Advantageously, said horizontal support element 4, said vertical support element 3, said means for holding 5 the drum, said sitting surface 6 and, if present, said seat console 7, said base 2, the seatback for seat 12 and the seatback console 13 are parts that have two flat opposite surfaces, and are preferably parts that can be obtained by cutting in a plate or sheet, and/or by cutting profiles in a orthogonal direction with respect to the direction of length thereof.

Another object of the invention relates to a kit comprising all of the parts required for assembling a support for a drum according to the invention.

DRAWINGS

FIG. 1*a*) illustrates a profile view of the assembly of the support 1 for a musical drum 10 in accordance with embodiments, with said support comprising a seat 6 and a means for holding 5 in the form of a profiled part 5 attached to a riser 3.

Figure 1B:
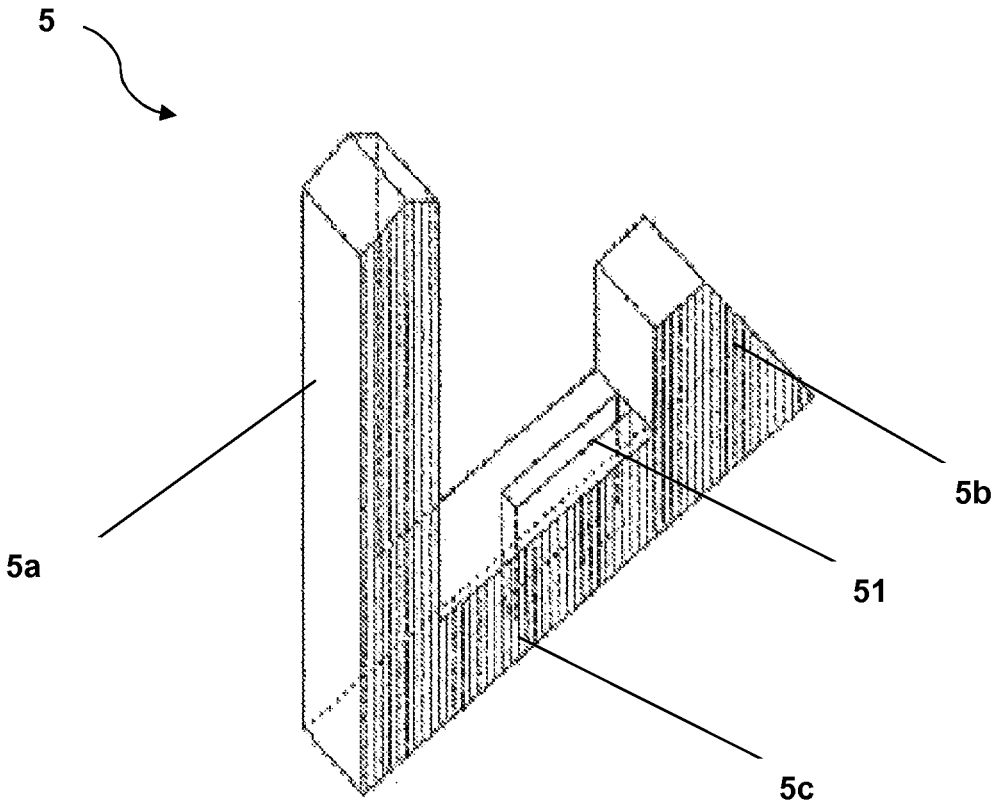

FIG. 1*b*) illustrates a detailed view of the profiled part 5 such as illustrated in FIG. 1*a*) (circle A), the profiled part 5 is essentially flat, comprises a middle portion 5*c* and two ends 5*a*, 5*b* adopting a bent shape. The profiled part 5 comprises a slot 51 arranged in the middle portion 5*c*.

Figure 2:
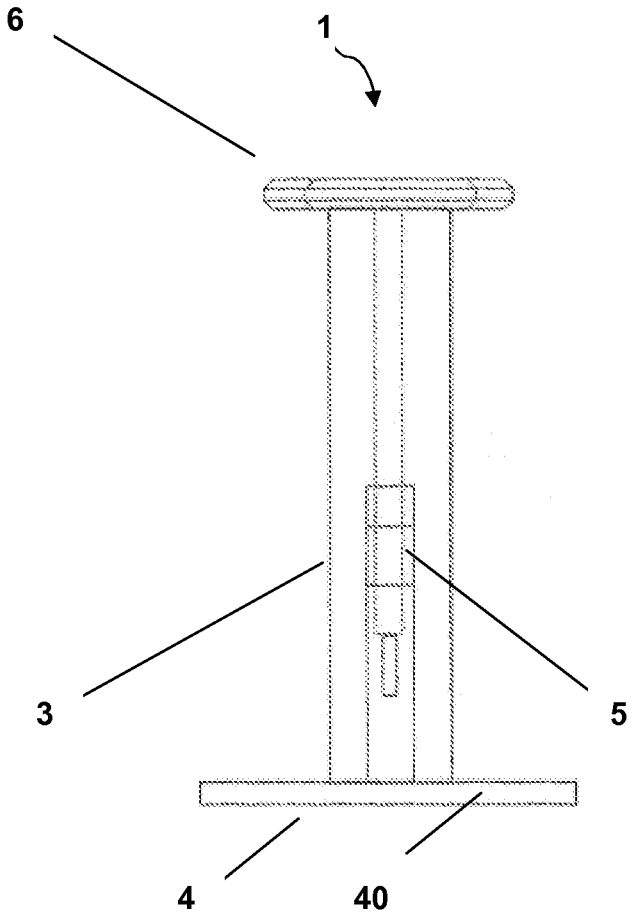

FIG. 2 illustrates a front view of the support 1 as illustrated in FIG. 1*a*), in accordance with embodiments.

Figure 3:
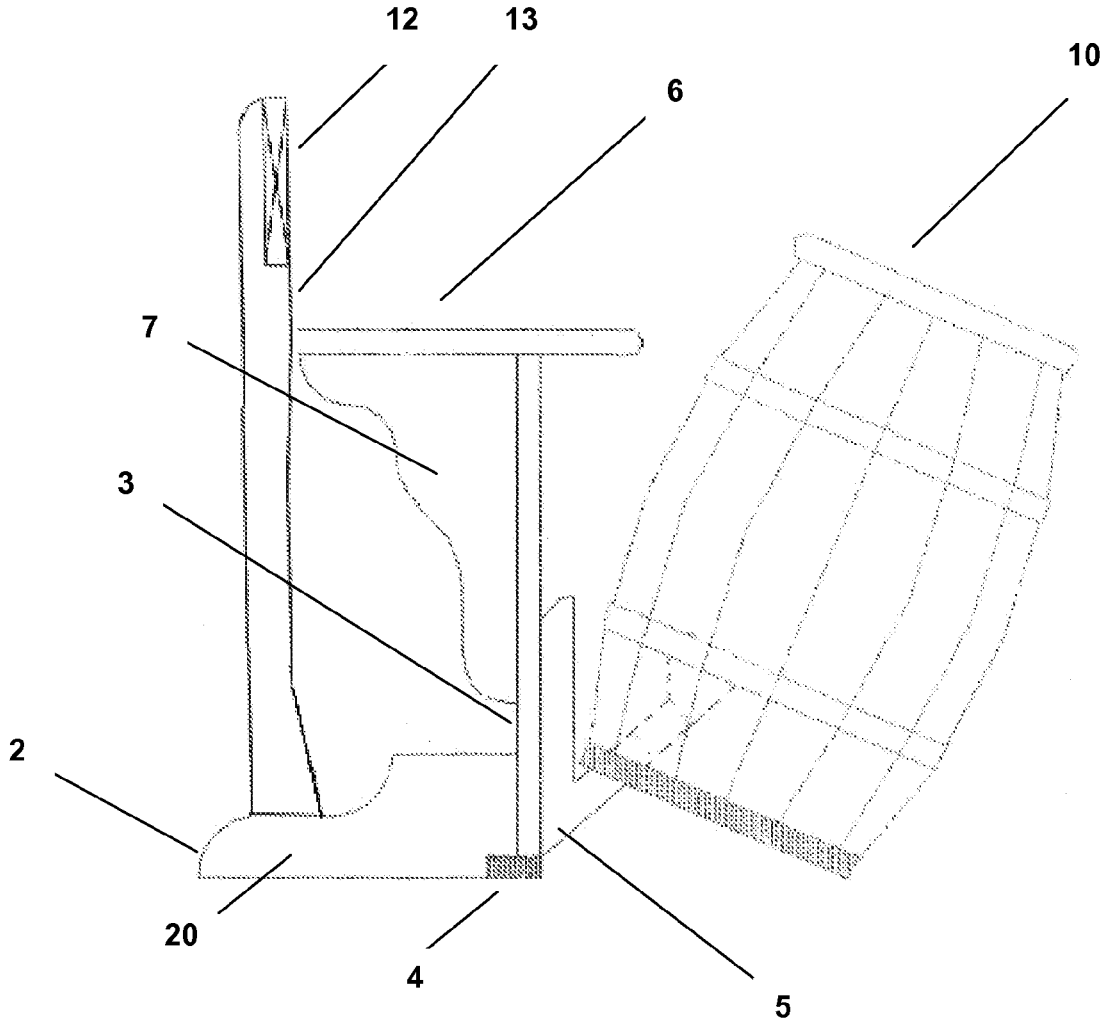

FIG. 3 illustrates a profile view of the support 1 comprising a seatback 12 supported by a seatback console 13, in accordance with embodiments.

DESCRIPTION

According to a first embodiment, and such as illustrated in FIGS. 1*a*) and 1*b*), the support 1 for a musical drum 10 with built-in seat 6 having a sitting surface comprises a plurality of substantially flat parts, and more particularly: a horizontal support element 4 (called a "foot" here) intended to stabilize the support; a vertical support element 3 (called a "riser" here) of which one of the ends thereof is attached to the foot 4, with the other end attached to the seat 6; and a means for holding 5 the drum 10 of which one of the ends 5*a* thereof is attached to the riser 3.

According to an essential characteristic of the invention, the means for holding 5 can have the form of an essentially flat profiled part 5, comprising a middle portion 5*c* and two ends 5*a*, 5*b* adopting a bent shape. The end 5*b* of the profiled part 5 is able to cooperate with the inner surface 11 of the musical drum 10 in order to hold it when it is being used by a person in a situation of playing. The second end 5*a* of the profiled part 5 also adopts a bent shape in such a way as to be able to attach the profiled part 5 to the riser 3. As such, the drum 10 once it is introduced until abutment into the profiled part 5 is tilted with respect to the floor. Consequently, the drum 10 is tilted and held solely by the support 1 thanks to the means for holding 5 being comprised by the profiled part 5, and thus without the player having to tilt or maintain the drum himself.

According to a particular embodiment of the invention, the bending angle, i.e. the angle between the end 5*a* and the middle portion 5*c* of the profiled part 5 is between 35° and 45°, preferentially between 37° and 43°, and even more preferentially between 39° and 41°.

In another particular embodiment according to the invention, the profiled part 5 is interchangeable, i.e. it can be disassembled from the support 1 and replaced with another part of the same type but having a different size (length). For example, the length of the middle portion 5*c* can vary from one profiled part to another according to the size of the drum. Indeed, for African drums of the djembé type, the length of the middle portion 5*c* has to be adapted in order to ensure the stability of said drums due to the great height of these types of drums.

Means for fastening the profiled part 5 arranged on one of the surfaces of the riser 3 are provided for this purpose in order to facilitate the assembly/disassembly of the profiled part 5 on the riser 3. In a first alternative, profiled recesses arranged in one of the surfaces of the riser 3 can be made in order to cooperate with protuberances arranged on one of the ends of the profiled part 5. Alternatively, protuberances arranged on one of the surfaces of the riser 3 can be made to cooperate with recesses arranged in the inner portion of one of the two ends of the profiled part 5.

Advantageously, the support 1 for a drum according to the invention further comprises a seat console 7 that makes it possible to solidify the support 1 under the weight of the drum player in a sitting position on the seat 6. In addition, a base 2 arranged in the lower portion of the support 1 can be added in order to reinforce the global stability of the support.

In a preferred embodiment, suction fastening devices are placed on the front surface 40 of the horizontal support element 4 and/or on the lateral surfaces 20 of the base 2 so as to improve the adherence to the floor of the support 1.

Finally, according to an alternative embodiment (cf. FIG. 3), the support 1 for a drum can further comprise a seatback 12 supported by a seatback console 13 that makes it possible to reinforce the feeling of comfort of the player. The seatback console 13 is connected to the seat 6 by a slot that is embedded in said seat 6, is attached at the top of the seat console 7 via a screw, and is fixed under the base 2 via a screw. The seatback 12 is fastened by two screws in the seatback console 13, said seatback console 13 being hollowed out by the width of the seatback so that said seatback 12 is in the continuity of the seatback console 13.

In a particular embodiment, the seatback 12 and the seatback console 13 can be removed. Indeed, the seatback 12 and the seatback console 13 can be added or removed on the support 1 independently of the other elements that comprise said support 1. In a first alternative of this embodiment, the removable seatback console 13 is attached on the one hand to the base 2 and on the other hand to the seat console 6 by fastening elements cooperating together, such as recesses and protuberances. For example, profiled recesses arranged in one of the surfaces of the seat console 6 can be made in order to cooperate with protuberances arranged on the seatback console 13. Alternatively, protuberances arranged in one of the surfaces of the seat console 6 can be made in order to cooperate with recesses arranged in the inner portion of the seatback console 13.

In another alternative embodiment, not shown here, the seatback 12 and the seatback console 13 can be retracted, i.e. the seatback 12 and the seatback console 13 are arranged in the form of a telescopic system that comprises a telescopic rod attached by an end to the base 2 by fastening elements that cooperate together, such as recesses or protuberances. This embodiment is particularly suitable when the seatback 12 and the seatback console 13 are made of metal.

According to a last embodiment according to the invention, the means for holding 5 comprises a slot 51 arranged in the middle portion 5*c* of said means for holding 5, said slot 51 being able to receive a screw nut. In this embodiment, the drum 10 must be pierced on the lower portion thereof in order to form a hole making it possible to insert the screw nut. The screw is inserted into the slot 51 of the means for holding 5*c*, then is inserted into the hole of the drum 10, then the whole is attached and tightened by means of a nut. A "butterfly" type nut is preferably used, as such avoiding the use of a wrench to tighten the unit. This additional fastening makes it possible to reinforce the stability of the drum 10 on the support 1. It also makes it possible to transport the drum 10 and the support 1 as a single unit, one made integral with the other.

The elements that constitute the support 1 for a drum, namely the base 2, the riser 3, the foot 4, the profiled part 5, the seat 6, the seatback 12, the seatback console 13 and the seat console 7 can be made from any suitable material, and more particularly from wood (in particular oak wood, or from precious woods from Guiana), or made of metal (in particular aluminum or steel) or even possibly of plastic material. In a particular embodiment, the elements that comprise the support 1 made of metal are covered with a covering, such as carpeting, in order to prevent the phenomenon of resonance of said elements that comprise the support 1.

According to another particular embodiment according to the invention, the support 1 for a drum can be provided in the form of a kit comprising all of the elements that constitute the support 1, namely the base 2, the riser 3, the foot 4, the profiled part 5, the seat 6, the seatback 12, the seatback console 13 and the seat console 7. Several profiled parts 5 can be included in the kit according to the drum used by the player. As such, the support 1 for a drum can be mounted in a modular and simple manner. The elements that comprise the support 1, except for the fastening elements to fasten the profiled part 5 to the riser 3, can be fastened together by the intermediary of known means for fastening such as screwing. Generally, the elements that constitute the support 1 have the form of parts that have two flat opposite surfaces, and preferably have the form of parts that can be obtained by cutting from a plate or sheet, and/or by cutting profiles in an orthogonal direction with respect to the direction of the length thereof. As such, the support 1 for a drum according to the invention has a great facility for machining. As it is comprised of flat parts, it can be packaged in a package of small size, which makes it easy to transport and dispatch.

The various embodiments and alternatives mentioned hereinabove can be combined together in order to implement the invention.

The support 1 for a drum according to the invention also has the advantage of being easy to mount, easy to disassemble and easy to transport by the user thereof. The support 1 for a drum according to the invention further has the advantage of being able to be used for drums of all sizes and of all shapes while still retaining a feeling of comfort for the player. The drum player can then adopt a correct sitting position by using the suitable profiled part 5 of the drum 10. Less tense, the muscles are less solicited; the player will no longer feel a set of muscular pains (stiffness of the back, hips, neck, arms, shoulders). The player can focus on the music. The invention then also leads to an improvement in the sound which becomes more powerful, cleaner and clearer.

An example of a support for a musical drum according to the invention comprising a seatback 12 supported by a seatback console 13. The support 1 for a drum 10 comprises a seatback console 13 of 68.5 cm high over 5 cm wide and a seatback 12 of 14.5 cm high over 26 cm wide. The seatback console 13 is connected to the seat 6 by a slot of 1 cm that is embedded in said seat 6, is fastened at the top of the seat console 7 by a screw, and is fastened under the base 2 by a screw. The seatback 12 is attached by two screws in the seatback console 13, said seatback console 13 being hollowed out by the width of the width of the dossier so that said seatback 12 is in the continuity of the seatback console 13. The bending angle between the end 5*a* and the middle portion 5*c* of the means for holding 5 is 40°. All of the parts that constitute the support are made of wood.

An example of dimensions of means for holding 5 according to the type of drum are as follows. Guianese drum: length of the middle portion 5*c* of the means of support 5=15 cm. African drum of the djembé type of about 90 cm in height: length of the middle portion 5*c* of the means of support 5=25 cm.

What is claimed is:

1. A support for a drum, comprising:
- a seat having a sitting surface;
- a horizontally-extending support element;
- a base;
- a seat console to stabilize said support;
- suction fastening devices placed on a front surface of the horizontally-extending support element and/or lateral surfaces of the base;
- a vertically-extending support element arranged on the horizontally-extending support element and which supports the sitting surface of the seat; and
- an element for holding the drum arranged on at least a surface of the vertically-extending support element, and which includes a flat profiled part, bent at ends thereof, of which a first of said ends is attached to said vertically-extending support element, and a second of said ends is to cooperate with an inner surface of the drum in order to hold the drum.

2. The support of claim 1, wherein a bending angle between the first of said ends and a middle portion of the element for holding is between 35° and 45°.

3. The support of claim 1, wherein a bending angle between the first of said ends and a middle portion of the element for holding is between 37° and 43°.

4. The support of claim 1, wherein a bending angle between the first of said ends and a middle portion of the element for holding is between 39° and 41°.

5. The support of claim 1, wherein said element for holding is interchangeable.

6. The support of claim 1, wherein the support is composed of wood and/or of metal.

7. The support of claim 1, wherein the support is composed of steel or aluminum, and/or a plastic material.

8. The support of claim 1, wherein the element for holding and the vertically-extending support element include fastening elements which cooperate with one another.

9. The support of claim 8, wherein the fastening elements are recesses and protuberances or dovetailed elements.

10. The support of claim 1, further comprising a seatback and a seatback console that are movable or retractable.

11. The support of claim 10, wherein the seatback console is attached to the base and the seat console.

12. The support of claim 10, wherein the seatback and the seatback console are telescopically arranged via a telescopic rod attached to the base.

13. A support for a drum, comprising:

a seat having a sitting surface;

a horizontally-extending support element;

a vertically-extending support element arranged on the horizontally-extending support element and which supports the sitting surface of the seat; and an element for holding the drum arranged on at least a surface of the vertically-extending support element, and which includes a flat profiled part, bent at ends thereof, of which a first of said ends is attached to said vertically-extending support element, and a second of said ends is to cooperate with an inner surface of the drum in order to hold the drum, wherein the element for holding comprises a slot arranged in a middle portion thereof and which is to receive an attaching system which fastens the drum to said element for holding.

* * * * *